United States Patent [19]

Chastain et al.

[11] Patent Number: 4,517,905

[45] Date of Patent: May 21, 1985

[54] PARTICULATE WASTE PRODUCT COMBUSTION SYSTEM

[75] Inventors: Charles E. Chastain; Donald R. King, both of Stuttgart, Ark.

[73] Assignee: PRM Energy Systems, Inc., Stuttgart, Ark.

[21] Appl. No.: 465,648

[22] Filed: Feb. 10, 1983

[51] Int. Cl.[3] ..... F23G 5/00; F23G 7/00

[52] U.S. Cl. ..... 110/346; 110/245; 110/258; 110/259; 110/347

[58] Field of Search ..... 110/245, 363, 346, 347, 110/258, 259; 165/104.16; 122/4 D

[56] References Cited

U.S. PATENT DOCUMENTS

| | | | |
|---|---|---|---|
| 3,411,465 | 11/1968 | Shirai | 110/245 X |
| 3,865,053 | 2/1975 | Kolze et al. . | |
| 4,159,000 | 6/1979 | Iwasaki . | |
| 4,308,806 | 1/1982 | Uemura et al. | 110/245 X |

FOREIGN PATENT DOCUMENTS

| | | | |
|---|---|---|---|
| 2517 | 1/1983 | Japan | 110/245 |

*Primary Examiner*—Edward G. Favors

*Attorney, Agent, or Firm*—Harvey B. Jacobson

[57] ABSTRACT

The carbon content of the residue from combustion of agricultural waste products is controlled and the fly ash content of the gaseous exhaust minimized by utilizing a portion of the combustion supporting air to enhance fluidization of the waste products above a fixed bed while being agitated by a rotating sweep arm inducing radially outward movement toward a residue collecting zone from which a sweep arm paddle displaces the residue into a discharge duct. The waste product feed is conveyed at a uniform weight flow rate to a central location in the combustion chamber above the bed from which of the feed is dropped onto the bed.

15 Claims, 8 Drawing Figures

PARTICULATE WASTE PRODUCT COMBUSTION SYSTEM

BACKGROUND OF THE INVENTION

This invention relates to the incineration of waste products such as rice and peanut hulls and the control of its ash residue.

The disposal of low value by-products from the processing of agricultural food crops, generally involves the burning of such by-products which creates many problems for the food producing industry. By-products such as rice and peanut hulls, for example, are tough, woody and abrasive. Further, such waste products are large in bulk, variable in density and have high ash and silica content. Incineration of such hulls is expensive, consumes large quantities of energy and creates air pollution problems.

The controlled combustion of the foregoing type of waste products has heretofore been attempted with little success from either an economic standpoint or from an ecological standpoint. Because of feed density variation, overfiring or underfiring often occurs during combustion resulting in unstable heat generation and exhaust gas quality that is not satisfactory for heat recovery purposes. For example, the introduction of waste products with high ash and silica content into the combustion chamber of a burner, generates an exhaust stream with excessive fly ash causing damage to and deterioration of boiler tubes because of silica related abrasiveness. Prior burners are also unable to control the degree of burn and therefore lack flexibility for control of the ash content of the combustion residue as a marketable product.

It is therefore an important object to provide an economical combustion system for low value waste products such as rice hulls that does not require pre-feed treatment or prior expensive processing of the waste product and accommodates wide variations in its bulk density occurring either naturally or from packaging or pelletizing for transport purposes.

Another object is to provide a combustion system for such low value waste products whereby the ash content of the combustion residue may be controlled and the fly ash content of its gaseous exhaust minimized.

SUMMARY OF THE INVENTION

In accordance with the present invention, a particulate waste product is fed as a solid horizontal fuel to a fixed fuel bed combustion chamber. The feed is regulated in order to introduce the feed into the combustion chamber at a substantially uniform weight flow rate despite its bulk density variation. The feed mixed with air is discharged from a temperature cooled end portion of the fuel stock feeding system at a central infeed location within the combustion chamber above the fuel bed onto which the particulate feed drops. Combustion supporting air is supplied to the combustion chamber at an overfire location and from an underfire location below the bed. The underfire axial inflow of air enters the combustion chambers through grate openings in the bed at a velocity sufficient to only help fluidize the particulate material thereabove while it is undergoing combustion. A water cooled radial sweep arm is rotated just above the bed to rake or sweep the particulate solids through the fluidizing zone of the combustion chamber at a speed sufficient to mechanically fluidize the solids and induce radially outward movement thereof under centrifugal force toward a non-fluidized collection zone above an imperforate peripheral portion of the bed. The upper inlet end of a residue discharge duct is connected to the imperforate portion of the bed at one location within the collection zone. A material displacing paddle is connected to the radially outer end of the sweep arm for rotation therewith to displace the ash residue from the collection zone into the residue discharge duct.

Operation of the foregoing apparatus with rice hulls as the particulate fuel evolves a gaseous exhaust that flows past the infeed location to an upper exhaust duct which delivers an exhaust that is free of fly ash to such an unexpected degree that it is useful as a heating medium for boilers or the like. By control of the uniform weight feed rate of the particulate fuel solids, the heat energy content of the exhaust may be varied to meet different requirements. Further, the carbon content of the ash residue may be varied by adjustment of the underfire air inflow rate between firing limits, in order to meet different market requirements for disposal of the ash residue.

BRIEF DESCRIPTION OF DRAWING FIGURES

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DETAILED DESCRIPTON OF PREFERRED EMBODIMENT

Figure 1:
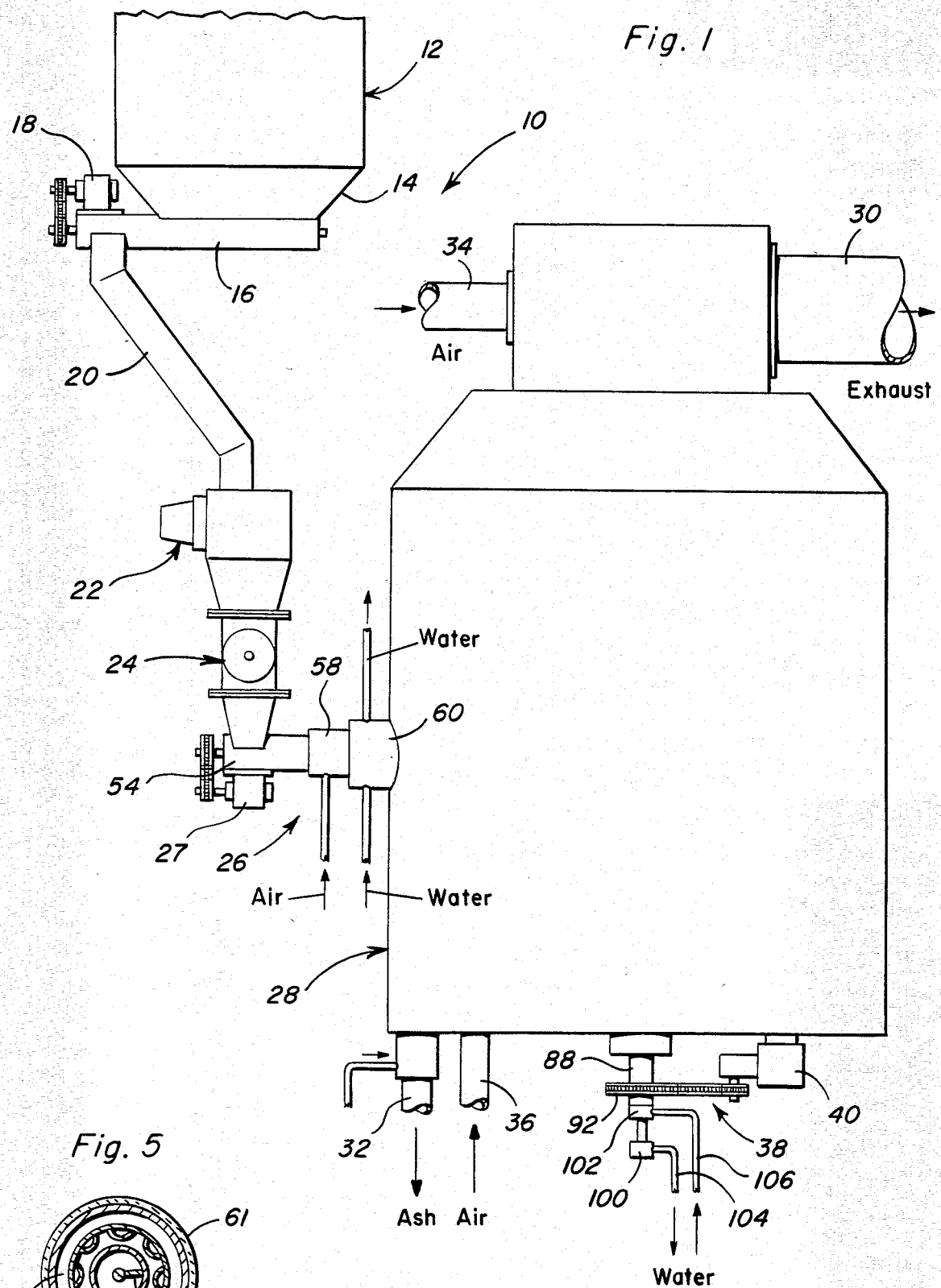
FIG. 1 is a simplified side elevation view of apparatus associated with the system of the present invention.
Figure 5:
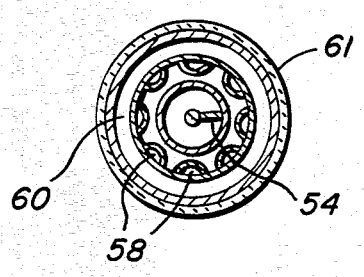
FIG. 5 is a partial transverse section view taken substantially through a plane indicated by section line 5—5 in FIG. 2.

Referring now to the drawings in detail, FIG. 1 illustrates typical apparatus for practicing the system of the present invention, generally referred to by reference numeral 10. A solid waste product, such as rice hulls, is stored in a fuel stock hopper 12 having a lower unloading end portion 14 from which the particular fuel enters an auger conveyor 16 attached to the hopper. The conveyor 16 is driven by a variable speed motor 18 to deliver the feed to the upper inlet end of a gravity duct 20 of generally rectangular cross-section. The lower delivery end of the duct 20 is connected to the housing of a flow meter 22 through which the feed passes into a rotary type of metering device 24. The flow meter 22 may be of a commercially available type, such as a "Sankyo" impact line flowmeter designed to measure the weight flow rate of the feed and generate an electrical signal reflecting such measurement. The signal output of the flow meter 22 is accordingly used to control drive of the variable speed motor 18 in order to maintain a substantially constant weight flow feed rate for the feed stock infeed mechanism generally referred to by reference numeral 26. The rotary metering device 24 is well known in the art and is utilized herein to prevent gas back-up.

The fuel infeed mechanism 26 is driven by a variable speed motor 27 and extends into a fuel burning combustion chamber device, generally referred to by reference numeral 28. The products of combustion include a gaseous exhaust discharged through an exhaust duct 30 from the upper end of the combustion chamber device, and an ash residue withdrawn through a duct 32 from the lower end. Combustion supporting air is supplied through an overfire inflow duct 34 at the upper end and an underfire inflow duct 36 at the lower end. An agitating mechanism 38 is associated with the device 28 and extends from its lower end for drive by a variable speed motor 40.

Figure 6:
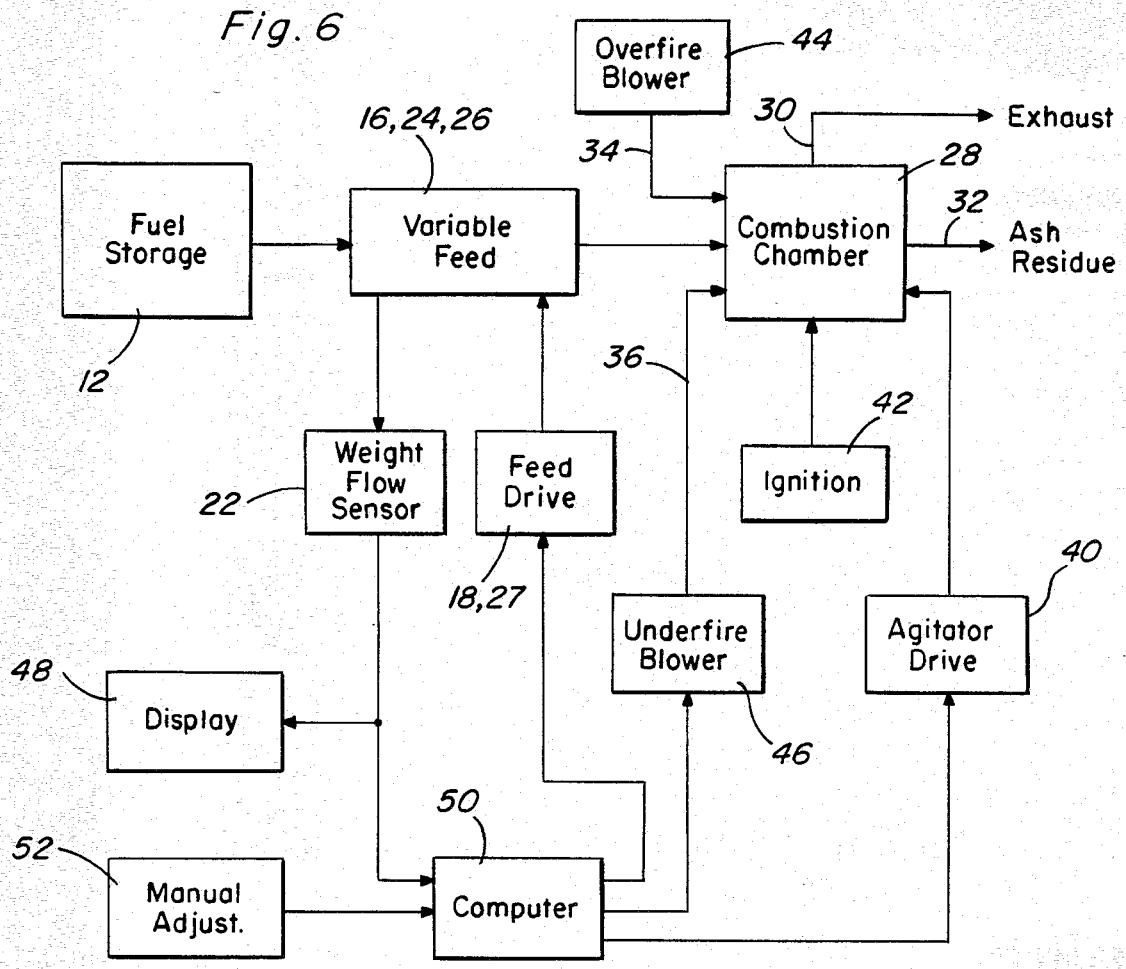
FIG. 6 is a block diagram schematically illustrating the system.

The system with which apparatus 10 is associated, is diagrammed in FIG. 6 showing the flow of the particulate fuel from storage 12 to the combustion chamber device 28 with which some form of igniting device 42 is associated as well as the agitator drive motor 40 aforementioned, and blowers 44 and 46 for supplying air through the overfire and underfire inflow ducts 34 and 36. The signal output of the flow meter 22 is fed to a visual display 48 and as an input to a computer 50 to which manual adjustment input data is also fed from 52. The computer produces outputs for control of the feed drives 18-28 in order to maintain an adjusted uniform weight flow rate for the fuel feed into the combustion chamber. Operation of the underfire blower 46 and agitator drive 40 may also be controlled by the computer. The computer if utilized is thus programmed to control the feed rate of the fuel, inflow rate of the underfire air and the speed of the agitator drive in accordance with the present invention.

Figures 2, 3, 4:
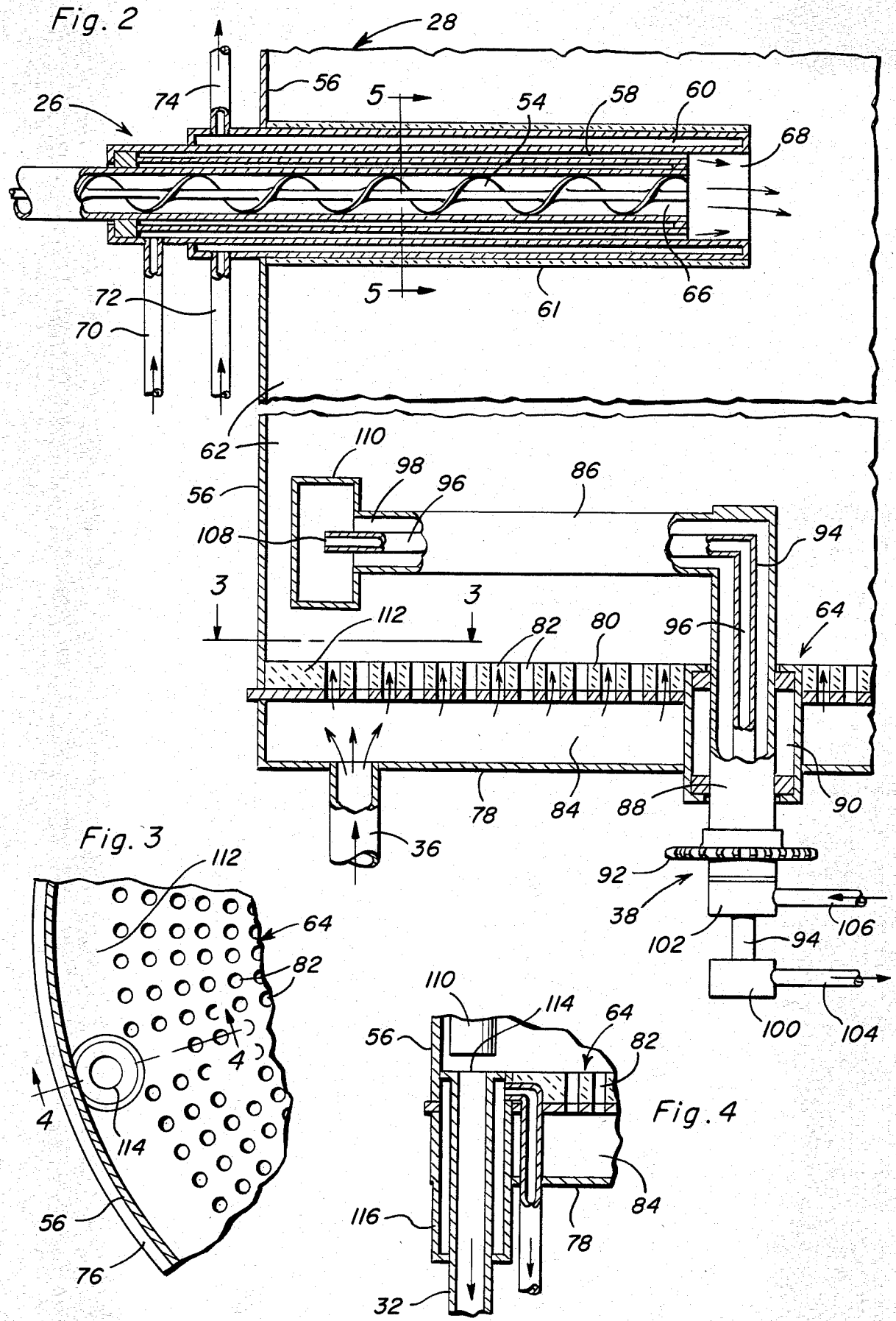
FIG. 2 is an enlarged partial side section view of the apparatus shown in FIG. 1.
FIG. 3 is a partial section view taken substantially through a plane indicated by section line 3—3 in FIG. 2.
FIG. 4 is an enlarged partial section view taken substantially through a plane indicated by section line 4—4 in FIG. 3.

Referring now to FIGS. 1 and 2, the fuel infeed mechanism 26, includes an auger type conveyor 54 driven by the motor 27 externally of the housing 56 of the combustion chamber device 28. The conveyor 54 is enclosed by air passages 58 and an outer water jacket 60 that extend into the housing 54 with the conveyor 54 to cool the conveyor within the high temperature environment of the combustion chamber 62 enclosed by housing 56 above a fixed, horizontal fuel supporting bed generally referred to by reference numeral 64. An insulating coating 61 is formed on the outer water cooling jacket 60 which extends axially beyond the discharge end 66 of the auger conveyor 54 to form a mixing space 68 at a central infeed location within the combustion chamber substantially aligned with the vertical longitudinal axis of the housing 56. The cooling air passages 58 open into the mixing space 68 so that air supplied thereto externally of the housing by conduit 70 will discharge into space 68 for mixing with the particulate fuel being discharged from the delivery end 66 of the conveyor 54. The annular water space of jacket 60 is closed at its inner end for circulation of water between inlet and outlet conduits 72 and 74. Thus, air and water cooling of the conveyor 54 enables it to function continuously in discharging a mixture of air and particulate solids at a relatively hot location in a thermal upflow of gaseous combustion products for decelerated gravitational descent toward the fuel supporting bed 64.

The space 68 not only provides for mixing of the particles with air before drop onto the bed, but also prevents back firing into the auger conveyor 54 and clears the discharge end thereof by the continued outflow of air from passages 58 when feed from the conveyor 54 is interrupted.

The bed 64 as shown in FIG. 2 includes a steel gas distributor plate 76 spaced above the bottom wall 78 of the housing 56 and a refractory plate 80 fixed to the steel plate. A major radially inner portion of the bed has closely spaced openings 82 to form a burner grate above an air dispersal space 84 to which the underfire air is conducted by conduit 36. Accordingly, the blower pressurized underfire air will be directed upwardly through the grate openings 82.

The particulates are mechanically fluidized during combustion by the agitator mechanism 38 which includes a radial sweep arm 86 extending through the fluidized zone from a rotor portion 88 supported by a sealed bearing assembly 90 for rotation about the vertical axis of the housing. The sweep arm will be closely spaced above the bed by an adjusted amount. The rotor 88 has a gear 92 fixed thereto externally of the housing for driving connection to the motor 40. A conduit 94 extends concentrically through the rotor 88 and sweep arm 86 to form an inner return flow passage 96 and an annular inflow passage 98, respectively, connected through fixed manifolds 100 and 102 to water outlet and inlet conduits 104 and 106. The end 108 of inner conduit 94 is open and disposed with a hollow paddle formation 110 connected to the radially outer end of the sweep arm 86. The interior of the paddle is in communication in the annular passage 98 so that water will circulate through the sweep arm and paddle for cooling thereof.

The paddle 110 is vertically spaced above a radially outer, imperforate portion 112 of the bed 64 over which a non-fluidized collection zone is established. It will be apparent that rotation of the sweep arm through the rotor portion 88 of the agitator mechanism not only fluidizes material during combustion, but also induces radially outward movement thereof under centrifual forces toward the non-fluidized collection zone above the annular imperforate portion 112 of the bed. Thus, an ash residue is collected on portion 112 of the bed and is displaced by the paddle 110 each revolution to the upper inlet end 114 of the residue discharge duct 32 as more clearly seen in FIGS. 3 and 4.

As shown in FIG. 4, a water cooling jacket 116 is mounted about the duct 32, which is connected at its upper inlet end to the imperforate portion 112 of the bed 64. The inlet end 114 is furthermore aligned with the paddle which cyclically passes thereabove to effect withdrawal of the ash residue collected on the portion 112 of the bed.

Figure 7:
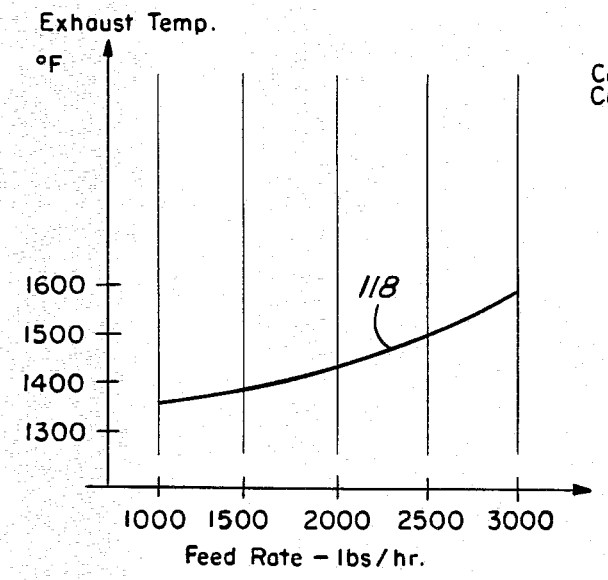
FIGS. 7 and 8 are graphical illustrations of certain operational characteristics of the apparatus and method for incinerating rice hulls in accordance with the present invention.

As a result of the arrangement of the apparatus hereinbefore described, the fly ash content of the exhaust gas is minimal despite the use of a feed having a high silica content. The exhaust gas will therefore be suitable as a heating medium for boilers, with a heat content that may be varied to suit different requirements by adjustment of the fuel feed rate. As an example, rice hulls having a bulk density varying between 6 and 10 $lb/ft^3$ and a fuel value of approximately 6000 BTU/lb. was utilized as the fuel feed in apparatus conforming to the description herein, to generate a useful exhaust gas, the heat content of which was varied as a function of fuel feed rate as shown by curve 118 in FIG. 7. The results depicted by the graph of FIG. 7 were obtained under conditions wherein the underfire and overfire inflow of air was maintained constant at 2000 cfm and 65,000 cfm, respectively, while the rotational speed of sweep arm 86 was maintained constant at 9.5 RPM. As indicated by the graph of FIG. 7 the heat content reflected by the temperature of the exhaust gas varied between 1360° F. and 1600° in response to adjustment of the feed rate between 1000 lbs/hr and 3000 lbs./hr.

Figure 8:
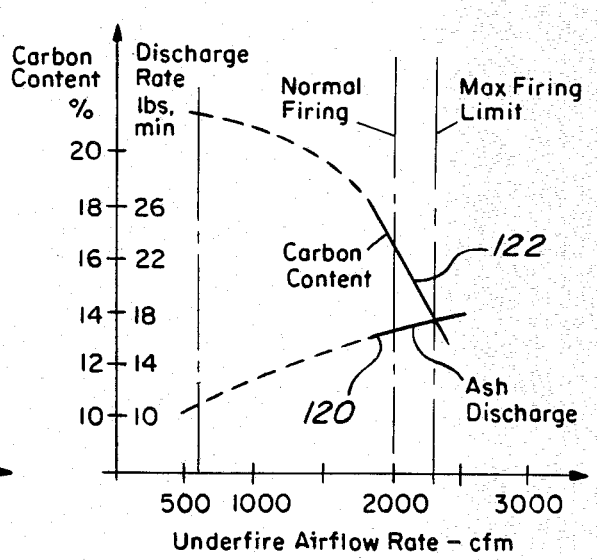

FIG. 8 illustrates the effect of adjusting the underfire inflow rate on the discharged ash residue, while maintaining the sweep arm speed constant at 9.5 RPM, the overfire air inflow rate constant at 6500 cfm and the fuel feed rate constant at a normal 2000 lbs./min. Curve 120 reflects an expected increase in ash discharge with an increase in the underfire airflow rate. Curve 122 on the other hand reflects a decrease in carbon content of the ash residue with an increase in underfire airflow rate. Thus, by adjusting the underfire airflow rate between minimum and maximum firing limits of 600 cfm and 2300 cfm, the carbon content may be predictably tailored to market requirements.

Further tests run on the foregoing apparatus utilizing the same rice hulls as the fuel feed, provide additional evidence of the unexpected control made possible on the ash residue product of the system described, by varying other system parameters, such as sweep arm speed and feed rate, in addition to the underfire air inflow rate. The results obtained from such test runs are summarized in the following table, based on a constant overfire air inflow rate of 6500 cfm.

| | | | Ash Residue | |
|---|---|---|---|---|
| Feed Rate (lbs/hr.) | Sweep Arm Speed (RPM) | Underfire Airflow (cfm) | Discharge Rate (lbs./min.) | Carbon Content (%) |
| 1500 | 3.0 | 600 | 6.2 | 43.2 |
| 1500 | 4.5 | 1200 | 7.6 | 38.2 |
| 2000 | 7.5 | 2000 | 9.3 | 11.6 |

It will be observed from the foregoing table that a substantial variation in carbon content of the ash residue may be obtained by adjustment of the fuel feed and sweep arm speed parameters which are inverse functions of carbon content and a direct function of the ash residue discharge rate.

The foregoing is considered as illustrative only of the principles of the invention. Further, since numerous modifications and changes will readily occur to those skilled in the art, it is not desired to limit the invention ot the exact construction and operation shown and described, and accordingly, all suitable modifications and equivalents may be resorted to, falling within the scope of the invention.

What is claimed as new is as follows:

1. A method of incinerating particulate solids by combustion above a horizontal bed within a combustion chamber to produce a useful exhaust heat medium having a minimal fly ash content and an ash residue product, including the steps of: mechanically fluidizing the solids within a particle fluidizing zone above said bed within the combustion chamber; physically displacing the particulate solids radially outward of the fluidizing zone during the mechanical fluidization thereof while undergoing combustion; receiving the ash residue product within a collection zone on the bed radially outward of the fluidizing zone; and conducting the exhaust heat medium from the fluidizing zone through the combustion chamber, said particulate solids being introduced at a substantially uniform weight feed rate, fluidization of the solids within said fluidizing zone being enhanced by an underfire inflow of air conducted through the bed at a flow rate between 600 and 2300 cubic feet per minute.

2. The method of claim 1 including the step of: supplying additional air to the combustion chamber above the bed at an overfire inflow rate sufficient to support said combustion in combination with the air supplied by said underfire inflow.

3. In a system for incinerating particulate solids by combustion within a housing above a horttzontal fuel supporting bed, including means for feeding said solids into the housing at a uniform weight feed rate, blower means for supplying pressurized air to the housing at a predetermined inflow rate to support said combustion, exhaust means for discharging gaseous products of said combustion from the housing and means for collecting ash residue of said solids undergoing combustion, the improvement including means conducting a portion of said pressurized air into the housing below the bed for enhancing fluidization of the solids above the bed within a combustion zone, said bed having a plurality of flow distributing openings through which said fluidizing portion of the air enter the combustion zone, and agitating means rotatably mounted within the housing for angularly sweeping the solids above the bed during combustion at a predetermined rotational speed, said collecting means including an imperforate portion of the bed onto which the ash residue from the combustion zone is radially displaced by the agitating means.

4. The improvement as defined in claim 3 wherein the feeding means includes an infeed conveyor projecting into the housing and having a discharge end centrally located internally within the housing below the exhaust means and above the bed onto which the solids are dropped, air cooling means mounted on the conveyor, and means for mixing air discharged from the air cooling means with the solids being discharged from the conveyor at said infeed location.

5. The improvement as defined in claim 4 including discharge conduit means connected to the imperforate portion of the bed for removal of the ash residue collected thereon.

6. The improvement as defined in claim 5 wherein the agitating means includes a sweep arm closely spaced above the bed, a material displacing paddle connected to the sweep arm in alignment with the imperforate portion of the bed therebelow, and means of imparting rotation to the sweep arm at said predetermined rotational speed.

7. The improvement as defined in claim 3 including discharge conduit means connected to the imperforate portion of the bed for removal of the ash residue collected thereon.

8. The improvement as defined in claim 7 wherein the agitating means includes a sweep arm closely spaced above the bed, a material displacing paddle connected to the sweep arm in alignment with the imperforate portion of the bed therebelow, and means for imparting rotation to the sweep arm at said predetermined rotational speed.

9. A method of enhancing combustion of waste products on a fixed horizontal bed within a combustion chamber to which combustion-supporting air is supplied at a predetermined rate insufficient to maintain fluidization of the waste products, including the steps of: introducing the air through the bed to the combustion chamber to enhance the fluidization of the waste products therein during combustion; raking the combustion chamber to mechanically effect said fluidization and induce movement of combustion residue toward a non-fluidized collection zone on the bed; and withdrawing the combustion residue of said waste products from the collection zone.

10. The method of claim 9 wherein said waste products are rice hulls.

11. The method of claim 10 wherein said predetermined rate of supply of air is between 7100 and 8800 cubic feet per minute including an inflow of overfire air at a constant inflow rate.

12. The method of claim 11 wherein said raking of the waste products is effected at a rotational speed of 9.5 RPM.

13. A method for incinerating combustible materials utilizing an incinerating apparatus containing a fluidized bed consisting of solid particles, a gas distributor plate disposed at the bottom of said bed and a stirrer disposed above said gas distributor plate, including the steps of: introducing an upwardly flowing stream of combustion supporting gas into the bed through said gas distributor plate at a velocity insufficient to maintain the solid particles in a fluidized state; continuously stirring the bottom portion of the bed to maintain the fluidized state of the solid particles and radially displace residual ash outwardly of the fluidized bed; feeding the solid particles into said apparatus so that it contacts said bed; and withdrawing the residual ash from a location in the apparatus radially outward of the bed.

14. The method of claim 13 wherein the rate of gas supply to said fluidized bed is less than the minimum fluidizing velocity of said solid particles.

15. The method os claim 13 wherein said gas distributor plate has an imperforate portion radially outward of the fluidized bed at the location from which the residual ash is withdrawn.

* * * * *